US008466848B2

(12) United States Patent
Guy et al.

(10) Patent No.: US 8,466,848 B2
(45) Date of Patent: Jun. 18, 2013

(54) BEAM SHAPING FOR WIDE BAND ARRAY ANTENNAE

(75) Inventors: Ronald Frank Edward Guy, Malden (GB); Bruno Peter Pirollo, Malden (GB)

(73) Assignee: BAE Systems PLC, London (GB)

( * ) Notice: Subject to any disclaimer, the term of this patent is extended or adjusted under 35 U.S.C. 154(b) by 1339 days.

(21) Appl. No.: 11/659,125

(22) PCT Filed: Nov. 15, 2006

(86) PCT No.: PCT/GB2006/050389

§ 371 (c)(1),
(2), (4) Date: Jan. 31, 2007

(87) PCT Pub. No.: WO2007/060478

PCT Pub. Date: May 31, 2007

(65) Prior Publication Data

US 2009/0009422 A1 Jan. 8, 2009

(30) Foreign Application Priority Data

Nov. 23, 2005 (GB) ..... 0526661.4

(51) Int. Cl.
*H01Q 21/00* (2006.01)

(52) U.S. Cl.
USPC ..... 343/853

(58) Field of Classification Search
USPC ..... 343/893, 850, 853; 342/368
See application file for complete search history.

(56) References Cited

U.S. PATENT DOCUMENTS

| | | | | | |
|---|---|---|---|---|---|
| 4,736,463 | A * | 4/1988 | Chavez | ..... | 359/107 |
| 4,743,911 | A * | 5/1988 | Evans | ..... | 342/375 |
| 5,124,712 | A * | 6/1992 | Caille et al. | ..... | 342/368 |
| 5,206,655 | A | 4/1993 | Caille et al. | | |
| 5,369,410 | A * | 11/1994 | Reich | ..... | 342/175 |
| 5,861,845 | A * | 1/1999 | Lee et al. | ..... | 342/375 |
| 6,417,804 | B1 | 7/2002 | Merlet et al. | | |
| 7,230,570 | B2 * | 6/2007 | Thomas et al. | ..... | 342/372 |
| 2004/0085239 | A1 | 5/2004 | Ukena et al. | | |

FOREIGN PATENT DOCUMENTS

| | | | |
|---|---|---|---|
| EP | 1 596 468 | A3 | 11/2005 |
| GB | 2 253 744 | A | 9/1992 |
| WO | 02/25776 | A1 | 3/2002 |

OTHER PUBLICATIONS

British (GB) Search Report (dated Apr. 24, 2006).
G.T. Poulton, "Antenna Power Pattern Synthesis using Method of Successive Projection", Electronics Letters vol. 22, No. 29, pp. 1042-1043, Sep. 1986.

(Continued)

*Primary Examiner* — Robert Karacsony
(74) *Attorney, Agent, or Firm* — Kenyon & Kenyon LLP

(57) ABSTRACT

An apparatus and method are provided for applying a fixed non-linear profile of power (amplitude) and delay to signals across the aperture of an array antenna having multiple antenna elements where multiple beams are formed to span the field of view of the antenna. Using such fixed profiles in combination enables a substantially constant beam width to be maintained across a wide range of operational frequencies, e.g. 6-18 GHz, ensuring that the points of overlap for adjacent beams does not drop below a certain level, e.g. −3dB, and hence maintaining a substantially uniform coverage across the field of view of the antenna at all frequencies in the range.

15 Claims, 10 Drawing Sheets

OTHER PUBLICATIONS

L.J. Chu, "Microwave Beam-Shaping Antennas", Massachusetts Institute of Technology, Technical Report No. 40, Jun. 3, 1947.

International Search Report, Jan. 30, 2007, from International Patent Application No. PCT/GB2006/050389.

Written Opinion of the International Searching Authority, Jan. 30, 2007, from International Patent Application No. PCT/GB2006/050389.

Nishio T. et al., "A High-Speed Adaptive Antenna Array With Simultaneous Multibeam-Forming Capability" IEEE Transactions on Microwave Theory and Techniques, IEEE Service Center, Piscataway, NJ, US, vol. 5, No. 12, Dec. 2003, pp. 2483-2494.

International Preliminary Report on Patentability, Jun. 5, 2008, from International Patent Application No. PCT/GB2006/050389.

* cited by examiner

BEAM SHAPING FOR WIDE BAND ARRAY ANTENNAE

FIELD OF THE INVENTION

This invention relates to array antennae and in particular to an apparatus and method for controlling beam shape in an array antenna so as to provide uniform coverage across the field of view of the antenna over a wide range of operational frequencies. An exemplary operational frequency range is from 6-18 GHz, but the exemplary embodiments and/or exemplary methods of the present invention may be applied to array antennae designed to operate with microwave and millimetric wavelength signals in the frequency range 500 MHz to 300 GHz.

BACKGROUND INFORMATION

In a typical application of a known array antenna, a set of beams are formed to span a field of view extending to ±45° in azimuth, with each of the beams pointing at fixed scan angles. To ensure that the beams span the field, tight limits may be set on the allowable crossover levels between adjacent beams so that there are no significant gaps in the coverage of the field. Nominally, the beams would be required to intersect at or above the −3 dB points in their far-field radiation patterns at an intended frequency of operation. However, it is known that the width of beams for an array antenna is inversely proportional to the frequency of the radiation. Hence, in the particular application considered, where the beam peaks are at fixed scan angles, the crossover points of adjacent beams vary considerably according to the frequency of operation so that, at higher frequencies, gaps are likely to develop in the coverage of the intended field. This limits the range of frequencies over which a known design of co-phased array antennae may be used.

It is known to try to overcome this problem of narrowing beam widths by varying the amplitude of signals across the elements of an array antenna according to frequency of operation. In one known approach, it has been suggested that "apodising" filters be connected to each element of an array to control the amplitude of the respective signals. Apodising filters provide low attenuation at lower frequencies and high attenuation at higher frequencies. The ideal filter characteristic for each element of the array is dependent on the position of the element within the array. For elements at the center of the array the filters should have a filter characteristic that varies only slightly with frequency whereas, for elements towards the edge of the array, the filters should have a filter characteristic that varies greatly with frequency. Thus, at the lowest frequencies, the filters would provide an approximately uniform illumination across the array, leading to a relatively narrow beam for this frequency of operation. At the higher frequencies the filters would produce a highly tapered illumination through greater attenuation of signals for elements towards the edges of the array, leading to a relatively wide beam for this frequency of operation and so compensating for the natural narrowing of the beam at those higher frequencies. By synthesising the ideal distribution of signal amplitude at each frequency, a detailed apodising filter characteristic may be defined for each element within the array. If these filter characteristics can be achieved, then approximately constant beam widths with relatively low side-lobes can be achieved over the desired operational frequency band so ensuring uniform coverage of the field of view. However, in practice, a filter design to achieve these characteristics could not be found. Although an approximation to the attenuation response could be achieved, the phase response could not be adequately controlled.

SUMMARY OF THE INVENTION

From a first aspect, the exemplary embodiments and/or exemplary methods of the present invention resides in an apparatus, for use with a multiple beam array antenna having a plurality of antenna elements, comprising an arrangement for applying a fixed non-linear profile of power in combination with a fixed non-linear profile of delay to signals in respect of elements of the antenna, wherein the profiles are selected to achieve a substantially constant shape of radiation pattern over a range of operational frequencies for each of the multiple beams.

It has been found that by applying a fixed non-linear profile of signal power (amplitude) and delay, in combination, across the aperture of an array antenna, where the profile shapes are optimised for a particular design of array antenna, a substantially constant shape of radiation pattern, i.e. a substantially constant beam width at least at the level of the points of overlap between adjacent beams, can be achieved to the extent that overlaps between adjacent beams can be maintained at their −3 dB points or above across a wide operational frequency range. Being fixed, the distributions are very much more easily implemented for a particular array antenna compared with previous attempts to use a frequency-dependent distribution of signal power alone.

Whereas it may be understood that radiation patterns may be shaped by adjusting the amplitude of signals or by adjusting the phase of signals across the aperture of an array antenna for the purpose of achieving a required field of coverage at a particular operating frequency, it has been found that by careful choice of amplitude profile and time delay profile across the aperture of the array, a required shape of radiation pattern can be maintained over a wide range of frequencies, enabling an array antenna to be used as a wideband antenna.

In an exemplary embodiment of the present invention, the profile of power and the profile of delay are substantially parabolic in shape. In particular, for the power profile, a greater attenuation is applied to the power of signals in respect of antenna elements towards the edges of the array in comparison with the attenuation applied to signals in respect of elements towards the center of the array. For the delay profile, a greater delay is applied to signals in respect of antenna elements towards the edges of the array in comparison with the delay applied to signals in respect of elements towards the center of the array.

The exemplary profiles of power and delay may be implemented conveniently in the optical domain. The profile of power may be implemented by applying a corresponding profile of power to respective laser carrier signals modulated with the radio frequency (RF) signals in respect of elements of the antenna. The profile of delay may be implemented by applying the profile of delay using different lengths of optical fiber in the optical signal path associated with each antenna element. These implementations may be conveniently achieved in association with an optical beam forming network.

In an exemplary embodiment of the present invention, the apparatus according to this first aspect includes an optical beam forming network operable to apply the profile of delay to optical signals passing through the network.

While an exemplary range of operational frequencies is from 6 to 18 GHz, the apparatus according to exemplary embodiments of the present invention may be optimised for use with other frequency ranges in the microwave and millimetric wavelength bands.

From a second aspect the present invention resides in a method for adjusting signals in a multiple beam array antenna having a plurality of antenna elements, to provide a substantially constant shape of radiation pattern for each of the beams over a range of operational frequencies, comprising applying a fixed non-linear profile of power and of delay to signals in respect of elements of the antenna.

From a third aspect, the exemplary embodiments and/or exemplary methods of the present invention resides in a beam forming network for use with a multiple beam array antenna having a plurality of antenna elements and an arrangement for applying a fixed non-linear profile of power to signals in respect of elements of the antenna, wherein the beam forming network is operable to apply a fixed non-linear profile of delay to signals in respect of elements of the antenna in addition to applying delays to form each of said multiple beams.

The apparatus and method from the first, second and third aspects of the exemplary embodiments and/or exemplary methods of the present invention, may be used with both fixed and scanning beams, where beam forming and application of the profiles is carried out in either the optical or the RF domain or a combination of the two.

The exemplary embodiments and/or exemplary methods of the present invention also extends to radar systems including apparatus according to the first and third aspects of the exemplary embodiments and/or exemplary methods of the present invention and to any platform, stationery or mobile, on which that apparatus is mounted.

Where the words comprise, comprises or comprising are used in the present patent specification, they are to be interpreted in their non-exclusive sense, that is, to mean, respectively, include, includes or including, but not limited to.

DETAILED DESCRIPTION

Exemplary embodiments of the present invention will be described in the context of an array antenna comprising sixteen equally-spaced receiving elements and an optical beam former arranged to provide four beams pointing in fixed directions, spanning a field of view of ±45° in azimuth, for use in the frequency range of 6 to 18 GHz with adjacent beams overlapping at their −3 dB points, ensuring full coverage of the field of view. The second cross-over points of beams may be at a level at least 20 dB below the beam peaks and the side-lobes may remain at a level below those second cross-over points. A conventional array would not be able to achieve this degree of coverage (or side-lobe levels) because narrowing beams with increasing frequency would leave gaps in the coverage between beam peaks.

It will be clear that exemplary embodiments of the present invention may be readily adapted to provide a transmitter as opposed to a receiver of multiple beams and to operate with different numbers of antenna elements, different frequencies and different numbers of beams.

An example of a known array antenna and optical beam forming network will now be described with reference to FIG. 1.

Figure 1:
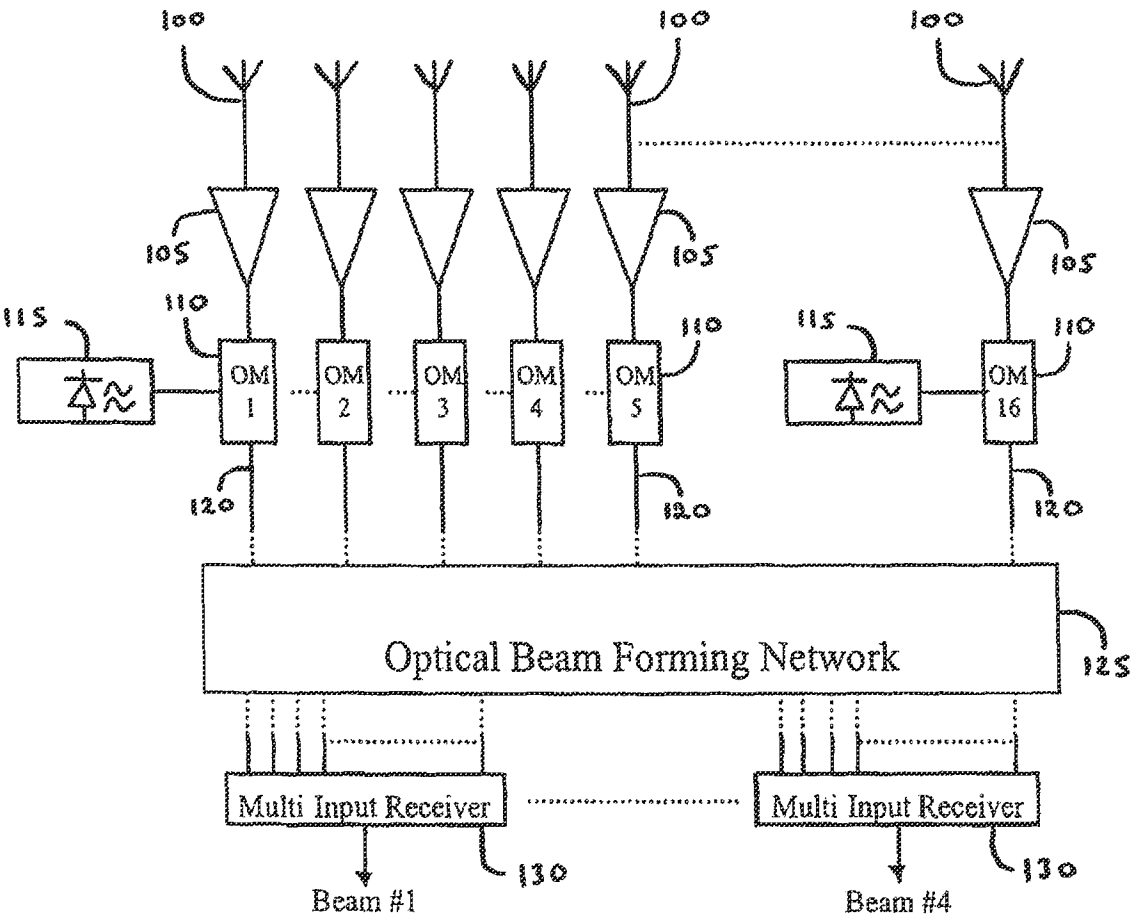
FIG. 1 is a representation of a known array antenna with an optical beam forming network.

Referring to FIG. 1, an array antenna of sixteen antenna elements 100 is represented, each antenna element 100 being connected to a low-noise amplifier (LNA) 105 for amplifying signals received at the respective antenna element 100. Each of the amplified signals is fed to a different optical modulator 110 operable to modulate light from a laser 115 with those signals. Modulated light from each of the optical modulators 110 is conveyed by a different optical fiber 120 to an optical beam forming network 125, operable to resolve and to output four different beams from the sixteen received signals. For each beam, sixteen optical outputs emerge from the beam forming network for input to a multi-input receiver 130 operable to combine the sixteen outputs into a single radio frequency (RF) output for the respective beam.

As mentioned during the introductory part of the description, above, it is a property of known types of array antenna and beam former that the width of the beams tends to reduce with increasing frequency, leading to gaps in the coverage of the field. However, the inventors in the present case have found that if a certain fixed profile of amplitude and of delay can be applied to signals received by the elements 100 of the antenna, then the narrowing of beams can be substantially eliminated over the operational frequency range of the antenna, 6 to 18 GHz in the present example, so maintaining uniform coverage of the field at all frequencies within the range. Exemplary profiles of amplitude and delay found suitable for use with the array antenna of FIG. 1 will now be described with reference to FIGS. 2 and 3.

Figure 2:
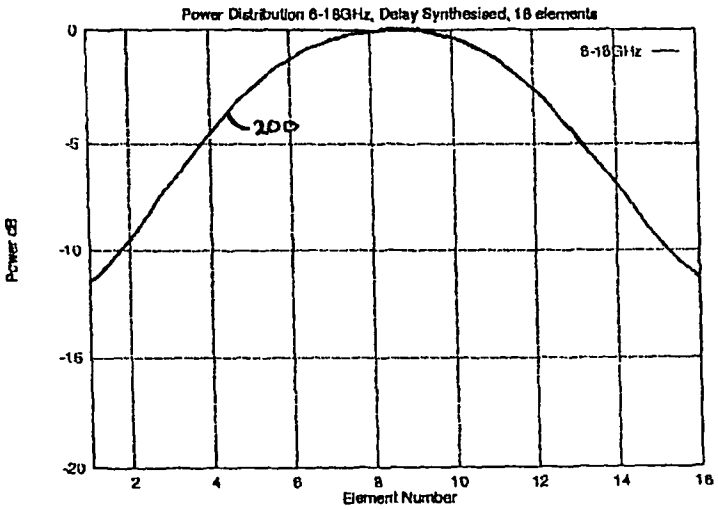
FIG. 2 shows an exemplary distribution of signal power across the aperture of an array antenna according to an exemplary embodiment of the present invention.

Referring to FIG. 2 initially, a graph is shown representing an exemplary profile of signal power (amplitude) across the elements 100 of the array antenna. The graph indicates that signal power may be gradually reduced for each successive antenna element 100 away from the central elements of the array, extending to a level of approximately −11.5 dB for the outer elements. This exemplary profile of signal power may be applied in either the RF domain or in the optical domain.

Figure 3:
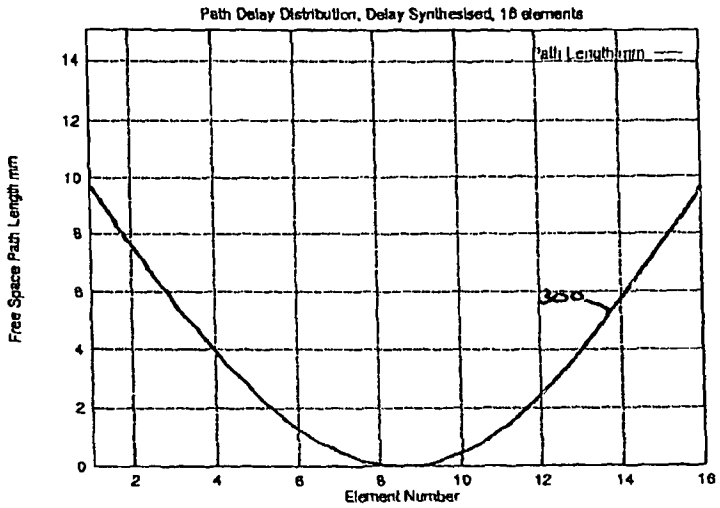
FIG. 3 shows an exemplary distribution of signal delay across the aperture of an array antenna according to an exemplary embodiment of the present invention.

Referring to FIG. 3, a graph is shown representing an exemplary profile of signal delay across elements 100 of the array antenna. The graph indicates that signal delay may be gradually increased for each successive antenna element 100 away from the central elements of the array. This exemplary profile of signal delay may be applied in either the RF domain or in the optical domain.

An exemplary process for determining an appropriate profile of signal power (200) and delay (300) for a particular design of array antenna will now be described in outline.

(1) The first step is to generate a required far-field radiation pattern at the lowest intended frequency of operation. This is done by synthesising a distribution of power across the aperture of the antenna which produces the required beam width and side-lobe level at this frequency—the synthesis frequency—using, for example, the method of successive projection as described by G. T. Poulton in "Antenna Power Pattern Synthesis using Method of Successive Projection", Electronics Letters vol 22, No. 29, pp. 1042-1043, September 1986.

(2) Using the far field pattern from step (1) as a template, a delay synthesis method, for example as described by L. J. Chu in "Microwave Beam-Shaping Antennas", Massachusetts Institute of Technology, Technical Report No. 40, Jun. 3, 1947, is used to generate a distribution of delay across the aperture of the antenna. This delay distribution has the same distribution of power as that produced at in step (1). As delays are used, the far-field radiation pattern remains approximately constant over the complete frequency range.

(3) In practice, as the above-referenced delay synthesis technique uses a geometrical optics approach, the radiation pattern does in fact change slightly with frequency. Several iterations of the synthesis procedures in steps (1) and (2) may therefore be required. For example, a first operation of the process may optimise the power distribution at a synthesis frequency equal to the lowest operational frequency but for which the radiation pattern deteriorates at higher frequencies. In this case, iterations of the process enable the power distribution to be synthesised to produce the desired beam width and side-lobe level at a higher frequency. By increasing the synthesis frequency, a better compromise of achieved beam width and side-lobe level over the desired operational frequency band can be obtained.

The resulting delay distribution can loosely be described as parabolic, with the greatest delay being applied at the edges of the antenna array. The power and delay distributions are kept fixed. At higher frequencies, the delay represents a larger parabolic phase distribution compared to that at the synthesis frequency. This has the effect of broadening the beam, and therefore counteracting the natural beam narrowing that occurs with antenna arrays using known distributions of power or delay across the antenna aperture. Thus, careful choice of power distribution, delay distribution, and synthesis frequency, allows the beam-width to remain substantially unchanged over a 3:1 instantaneous bandwidth.

The following table provides, in tabular form, the exemplary measurements of power (amplitude) and delay shown in FIG. 2 and FIG. 3 respectively. As the distributions are symmetric, only the values for elements 1-8 are shown in the table. Delays are expressed in terms of path length in free space.

| Element Number | Amplitude (dB) | Path Length (mm) |
|---|---|---|
| 1 | −11.48 | 9.62 |
| 2 | −9.56 | 7.61 |
| 3 | −6.93 | 5.68 |
| 4 | −4.51 | 3.93 |
| 5 | −2.61 | 2.43 |
| 6 | −1.25 | 1.24 |
| 7 | −0.41 | 0.42 |
| 8 | 0 | 0 |

An apparatus arranged to implement the power and delay profiles 200 and 300 of FIG. 2 and FIG. 3 respectively will now be described with reference to FIG. 4 according to an exemplary embodiment of the present invention. Features in common with the apparatus of FIG. 1 are given the same reference numerals.

Figure 4:
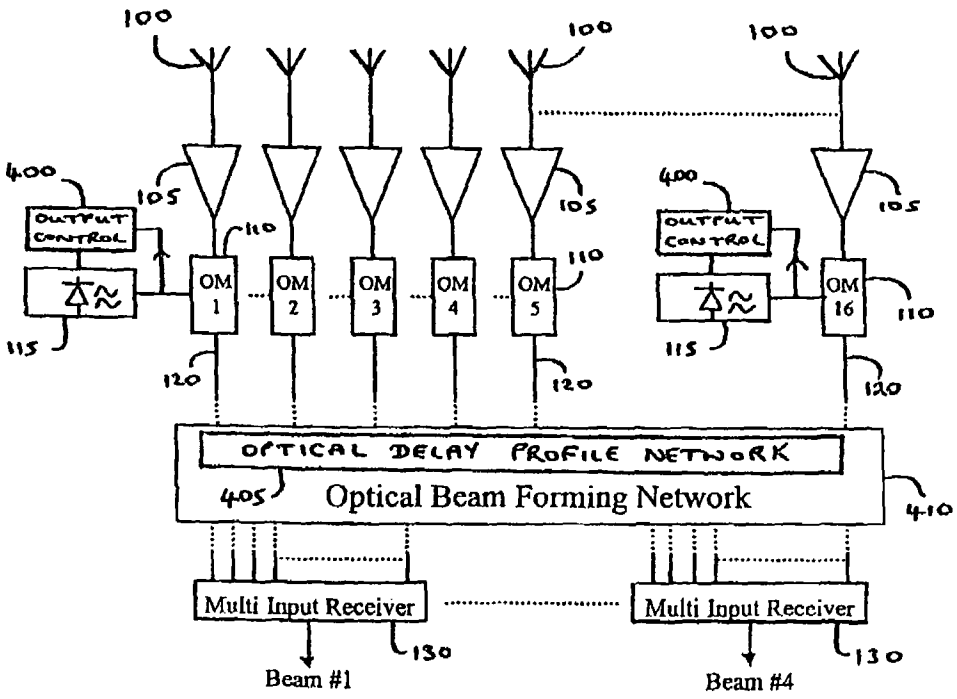
FIG. 4 is a representation of an antenna array and optical beam forming network according to an exemplary embodiment of the present invention.

Referring to FIG. 4, an array antenna of a similar design to that of FIG. 1 is represented. A laser output controller 400 has been connected to each of the lasers 115 to control the laser's light output power. Each controller 400 is configured to ensure that its respective laser 115 outputs light at a different relative power level, as defined on the power profile 200 of FIG. 2, according to the respective antenna element 100. In this way, the power profile 200 may be implemented in the optical domain rather than in the RF domain. The inventors in the present case have shown that implementation in the optical domain provides a 2 dB signal-to-noise ratio improvement over an equivalent implementation in the RF domain, e.g. by attenuating the respective RF signal at each of the multi-input receivers 130.

The apparatus of FIG. 4 has also been provided with an optical delay profile network 405 comprising sections of optical fiber of different lengths, each section of fiber being connected in the optical path between the optical modulator 110 of a respective antenna element 100 and an optical beam forming network 410. Each section of optical fiber in the delay profile network 405 adds an appropriate length of optical fiber to the total optical path for a particular antenna element 100 so as to implement a time delay equivalent to that represented by the free space path length indicated for that antenna element 100 in the delay profile 300 of FIG. 3. However, while a separate optical delay profile network 405 is shown in the embodiment of FIG. 4, an appropriate distribution of optical fiber lengths can be implemented anywhere within the optical paths of each antenna element 100, for example in the interconnecting sections 120 of optical fiber linking the optical modulators 110, which may be located close to the antenna elements 100, and the optical beam forming network 410 which may be located "centrally", potentially some distance from the antenna elements 100. Alternatively, the different lengths of optical fiber of the delay profile network 405 may be incorporated within the optical beam forming network 410 itself.

An exemplary implementation of a four beam optical beam forming network 410 and a method for its manufacture will now be described with reference to FIG. 5 and to FIG. 6, according to an exemplary embodiment of the present invention. Conveniently, the exemplary optical beam forming network 410 is implemented in the form of two separate boards, one for use with elements 1 to 8 of the antenna array and the other for use with elements 9 to 16. In each board, the optical fibers and other components are encapsulated within a layered structure of sheet materials of a type and using techniques known from printed circuit board (PCB) technology. As such, the beam former 410 is implemented according to what is known as a "fiber-in-board" design. In exemplary applications of the present invention, the optical beam forming network 410 may need to be implemented as a robust device, not only to protect the delicate optical fibers and other components associated with the network 410 but also to compensate for other environmental conditions such as vibration which might lead to microphonically-induced components in analogue signals being carried by the network 410. With appropriate choice of materials a fiber-in-board design helps to satisfy those requirements.

Figure 5:
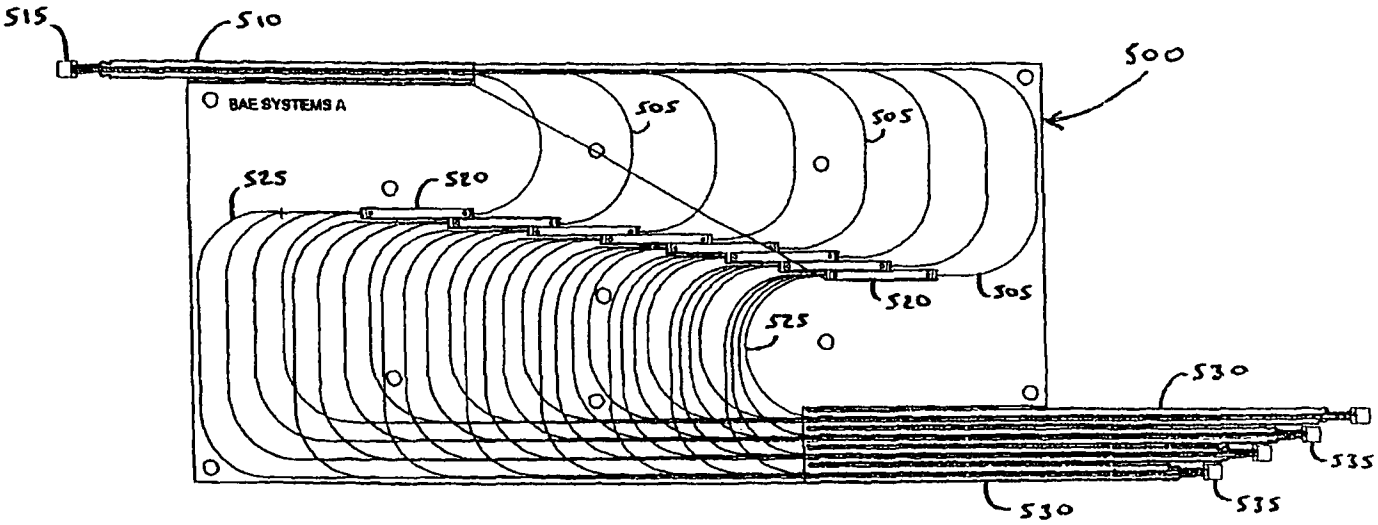
FIG. 5 shows the layout of a fiber-in-board optical beam forming network according to an exemplary embodiment of the present invention.

Referring to FIG. 5, a plan view is provided of a section through one of the pair of similar boards 500 implementing the exemplary fiber-in-board optical beam forming network 410. Optical fibers 505, 525 forming the network 410 are encapsulated within a single plane through the board 500, except in those regions where fibers 525 are required to overlap. Thus the representation shown in FIG. 5 is a plan view of a section taken through the board 500 within that single plane showing the layout of the optical fibers 505, 525. Optical signals generated by eight of the sixteen optical modulators 110 enter the beam forming network board 500 through a flexible input tail section 510 containing eight optical fibers 505, and fitted with a standard MT8 optical connector ferrule 515. On entering the board 500, each of the eight optical fibers 505 follow differently curved paths to connect with one of eight four-way optical splitters 520, each splitter 520 providing a four output fibers 525 to one input fiber 505, one output fiber 525 for each beam to be formed by the network 410. Each of the four output fibers 525 from the optical splitters 520 then follows a differently curved path through the board to one of four flexible output tails 530, one output tail 530 for to each of the four beams to be formed. One fiber 525 output from each splitter 520, and hence one fiber in the optical path from each antenna element 100, enters each of the flexible output tails 530 so that eight fibers are brought together in each output tail 530. A standard MT8 optical connector ferrule 535 is attached to the end of each flexible output tail 530.

The curved paths followed by the optical fibers 505 and 525 are carefully formed in the board material so that the total optical path length for each of the eight sets of fibers 505, 525 relating to a particular beam, from the point of input at the connector 515 to the point of output at the respective output tail connector 535, is the same. However, the total path length for fibers 505, 525 relating to each of the four beams is different, according to the relative delay required to form each beam.

Figure 6:
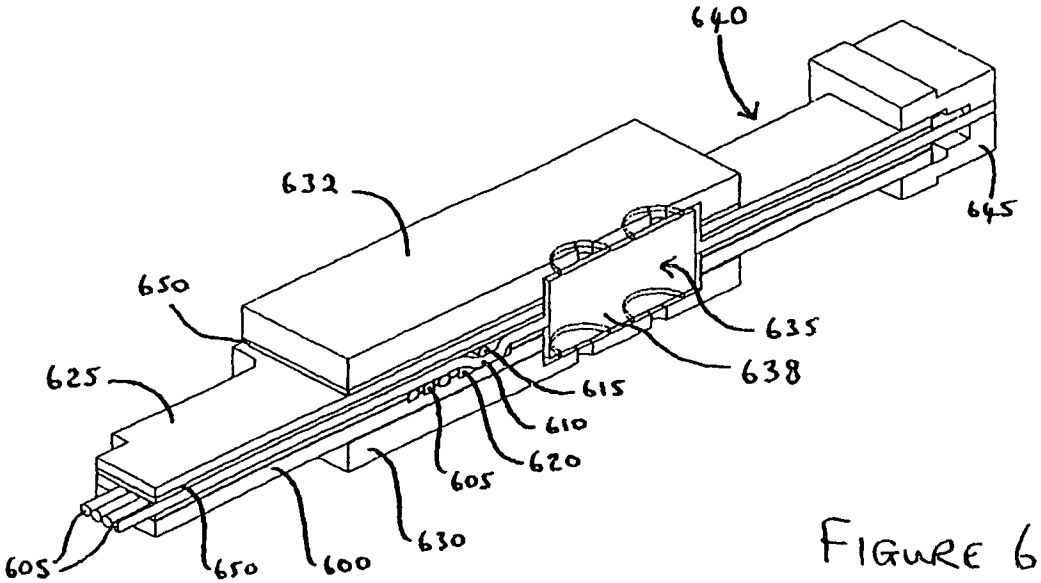
FIG. 6 shows a section through part of a typical fiber-in-board implementation of an optical beam forming network according to exemplary embodiments of the present invention.
Figure 7:
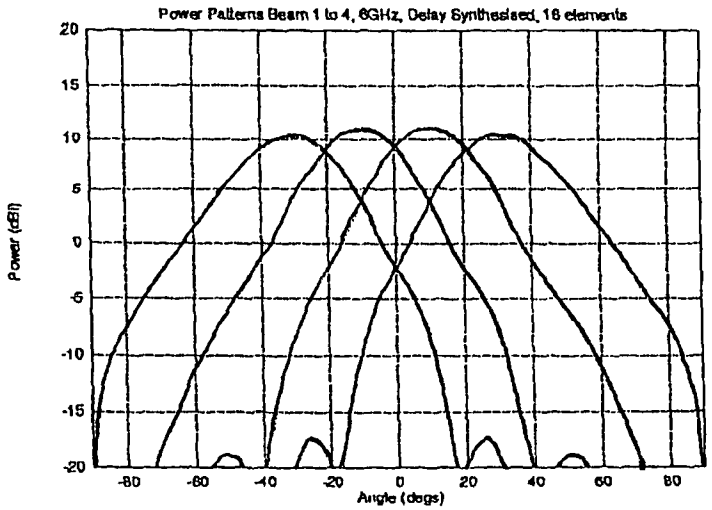
FIG. 7 shows a predicted far-field radiation pattern at 6 GHz for an array antenna and optical beam forming network according to exemplary embodiments of the present invention.
Figure 8:
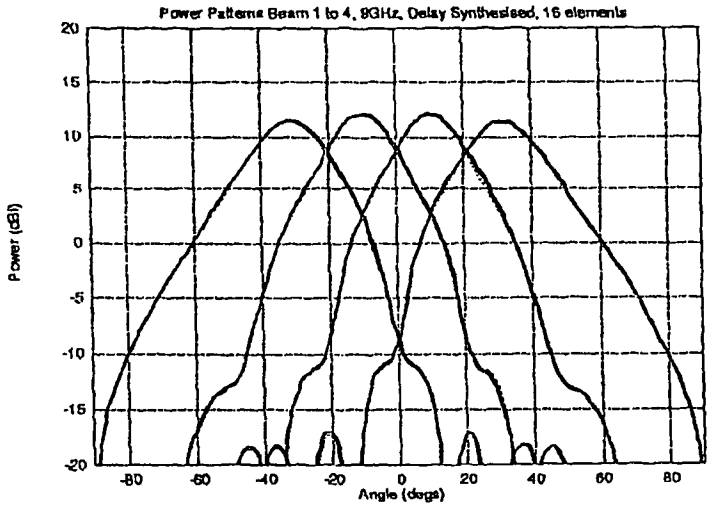
FIG. 8 shows a predicted far-field radiation pattern at 9 GHz for an array antenna and optical beam forming network according to exemplary embodiments of the present invention.
Figure 9:
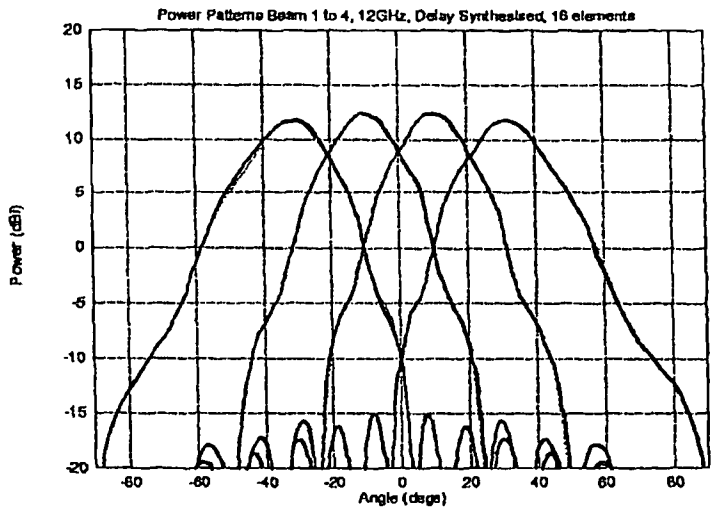
FIG. 9 shows a predicted far-field radiation pattern at 12 GHz for an array antenna and optical beam forming network according to exemplary embodiments of the present invention.
Figure 10:
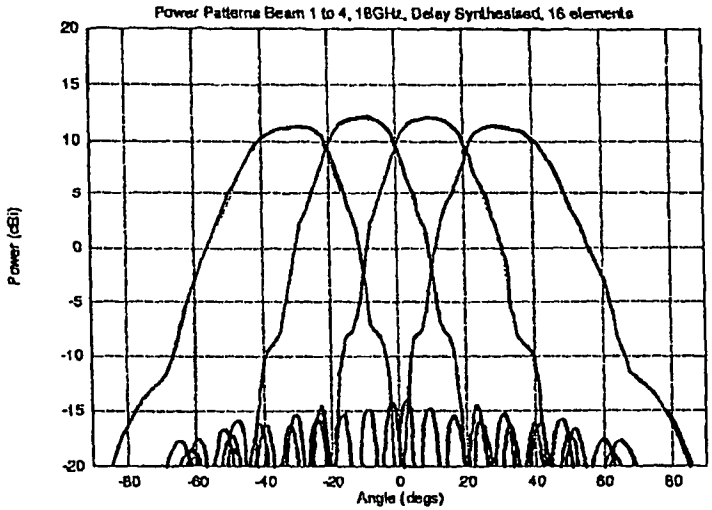
FIG. 10 shows a predicted far-field radiation pattern at 18 GHz for an array antenna and optical beam forming network according to exemplary embodiments of the present invention.

Referring to FIG. 6, a perspective view is provided of a section, taken perpendicularly to the plane in which the optical fibers are disposed, through part of a fiber-in-board optical beam forming network 500 to illustrate the main structural features of the board 500. The board 500 is assembled using a number of layers of different material according to the physical characteristics required of the board. In this exemplary embodiment, making use of materials known from PCB technology, the optical fibers 605, 610, 615 are housed within a pattern of trenches cut into a first flexible sheet of polyimide material 600, which may be more than twice the thickness of an optical fiber (typically 0.76 mm). Being more than twice the thickness of a fiber enables a double-depth section of trench 620 to be cut into the material 600 where one fiber, 610 for example, is required to pass beneath another fiber 615. A further, covering layer 625 of flexible polyimide material is bonded to cover the optical fibers entrenched in the first layer 600. To provide mechanical rigidity over a substantial proportion of the area of the board, a layer 630, 632 of an epoxy glass composite material is bonded to the exposed faces of the flexible polyimide layers 600, 625 respectively. Besides providing rigidity, the epoxy glass composite layers 630, 632 provide additional depth to the board enabling pockets 635 to be cut into the board to accommodate devices such as optical splitters 638, as required for the exemplary beam forming network 410 of the exemplary embodiments and/or exemplary methods of the present invention.

A flexible connector tail 640 may be formed from a section of bonded polyimide layers 600, 625 that is not bonded to an epoxy glass composite layer 630, 632, so retaining its flexibility. A standard optical connector ferrule 645 is attached to the end of the flexible connector tail 640 to provide an optical connection to the optical fibers embedded within the tail 640. This technique is used to provide the flexible input and output tails 510, 530 respectively of the exemplary fiber-in-board network 410 described above with reference to FIG. 5. Optionally, thin layers 650 of copper masking may be provided between each of the layers of material as an aid to manufacture of the board, providing a barrier when using laser cutting techniques, for example, to ensure the correct depth of cut for optical fibers 605, 610, 615 or other components to be encapsulated within the board. Standard etching techniques may be used to etch away sections of the copper masking 650 where required to increase the depth of cut.

In order to emphasise certain advantageous features of the exemplary fiber-in-board optical beam forming network board 500, an exemplary process for manufacturing such a board, in particular the board 500 described above with reference to FIG. 5 and making use of structural features described above with reference to FIG. 6, will now be described in more detail with reference to those same figures. However, it will be clear that such a process is not limited to the manufacture of beam forming networks of the type described above and may include other electrical and optical components besides those required to form the particular network design that has been implemented as in FIG. 5.

(1) Firstly, a base sheet is formed by bonding a sheet of flexible polyimide material 600 of an area sufficient to include the required flexible input and output tails 510, 530 and of the required thickness, which may be more than twice the thickness of the optical fibers 505, 525 to be encapsulated, to a similarly-sized sheet 630 of an epoxy glass composite material using an epoxy adhesive or another known bonding technique. A covering sheet of the same area as the base sheet is then formed in a similar way to the base sheet using a thin (0.125 mm) layer 625 of polyimide material that is bonded to a layer 632 of epoxy glass composite material. However, in those regions of the base sheet and the covering sheet in which flexible input and output tails 510, 530 are to be formed, there must be no bonding between the polyimide layers 600, 625 and the epoxy glass composite layers 630, 632 so that the epoxy glass composite layers 630, 632 can eventually be cut away to leave the flexible tails 510, 530.

(2) Computer numerically controlled (CNC) machining equipment is then used to directly machine the polyimide surface of the base sheet to accurately form a predetermined pattern of trenches of the same depth but very slightly less wide than the nominal thickness of the optical fibers 505, 525 to be encapsulated, with short sections of twice the depth of an optical fiber where the fibers 525 are required to overlap. The trenches may be cut using a three axis CNC YAG 355 nm laser. The flexible input and output tails 510, 530 are also formed using the laser by cutting away sections of the polyimide layer to form tails of the correct length for each beam. The design of the ends of the flexible tails 510, 530 may precisely match the intended optical connector ferrule 515, 535 that will eventually be attached. Conveniently, reference shoulders are cut at the ends of each tail section 510, 530 in the base and covering sheets to ensure that the optical connector ferrule 515, 535 can be attached at precisely the correct position to maintain the intended end-to-end optical path length through the network 410.

(3) Pockets are formed of an appropriate depth to house the optical splitters 520 or other components in both the base sheet and in corresponding positions in the covering sheet. The pockets are machined conventionally. Conveniently, a room temperature adhesive bonding tape, such as Tessa 4965, may now be applied to the polyimide surface of the covering layer and cut away from the pockets.

(4) Conveniently, the base sheet, with its pattern of trenches and pockets, forms an optical bench for mounting the various optical/electrical components. If required, conventional copper tracks may be provided to provide electrical connections to components embedded in the pockets. The optical fibers 505, 525 and the optical splitters 520 are then laid into the trenches and pockets respectively. Conveniently, having machined the width of the trenches to be slightly smaller than the nominal diameter of the fiber cladding, the fibers 505, 525 will be temporarily retained by friction through deformation of the fiber cladding for the duration of assembly.

(5) Once all the optical fibers and components of the beam forming network 410 have been placed into their trenches and pockets respectively in the base sheet, the covering sheet is carefully aligned and bonded to the base sheet —polyimide surface to polyimide surface—to encapsulate the network 410. In particular, the reference shoulders at the ends of each flexible tail section 510, 530 must be precisely aligned. The process used for bonding the covering sheet to the base sheet must be selected to ensure that the fibers and other optical components are not damaged. An adhesive may be selected for bonding which may be used at room temperature and requires no significant bonding pressure.

(6) Once the top sheet is bonded to the base sheet, the regions of epoxy glass composition material covering, but not bonded to, the sections of polyimide material forming the flexible input and output tails 510, 530 can be cut away. Similarly, any unused regions of the board 500 having no components within may be sawn away to reduce the overall size of the board 500. With the flexible tails 510, 530 now exposed, standard MT8 optical connector ferrules 515, 535 can be attached to the ends of the flexible tails 510, 530. These connectors 515, 535 should abut the reference shoulder formed on the end of each tail 510, 530 to maintain control of the respective optical path length. The flexible tail design is optimised for interfacing with the ferrule 515, 535. If required, secondary polishing of the connector ferrule 515, 535 can be used to finely adjust the time delay of the network 410, once the optical path length of the network 410 has been accurately measured.

To demonstrate the beneficial wideband performance of an array antenna and associated beam forming and profiling apparatus according to exemplary embodiments of the present invention, some radiation patterns are included as FIGS. 7, 8, 9 and 10 showing the far-field power distribution of radiation expected for each of the four beams at four different operating frequencies —6 GHz, 9 GHz, 12 GHz and 18 GHz.

Referring to FIGS. 7, 8, 9 and 10, it can be seen that coverage of a field of view of ±45° in azimuth is achievable with four beams across a frequency range of 6-18 GHz without significant (i.e. below −3 dB) gaps appearing in the coverage between beams. It has also been found through tests on the effect of vibration in the apparatus, particularly vibration of a fiber-in-board implementation 500 of a beam forming network 410 according to exemplary embodiments of the present invention, that induced microphonic effects are substantially reduced in the analogue signals carried by the optical fibers in comparison with prior art optical beam forming networks. The exemplary fiber-in-board implementation is therefore particularly suited to mounting on land, sea or air vehicles known to suffer high levels of vibration.

As a further benefit, it has been found that an optical beam forming network 410 implemented according to exemplary embodiments of the present invention does not introduce any additional optical transmission loss beyond that expected from the individual optical components and the connector interfaces. It is assumed that in a particular design of optical fiber layout in a fiber-in-board optical beam forming network 500 according to exemplary embodiments of the present invention that any bend radii in the optical fibers 505, 525 are larger than the minimum bend radius specified by the manufacturer of those fibers.

Whereas exemplary embodiments of the present invention have been described in the context of a 16-element antenna array and of four beams, the apparatus and methods described may be readily applied to antenna arrays with larger or smaller numbers of antenna elements and/or beams.

The invention claimed is:

1. An apparatus for controlling the shape of beams in a far-field radiation pattern, comprising:

a wideband multiple beam array antenna having a plurality of antenna elements and a wideband operational frequency range;

an output controller for applying a fixed non-linear substantially frequency-independent profile of power to signals in respect of elements of the antenna across the wideband operational frequency range; and a passive time delay unit for applying, in combination with the fixed profile of power, a fixed, non-linear, substantially frequency-independent profile of time delay to said signals across the wideband operational frequency range, wherein said signals are of any frequency within said wideband operational frequency range, and the fixed profiles of power and time delay are selected to achieve a substantially constant shape of radiation pattern over said wideband operational frequency range for each of the multiple beams.

2. The apparatus of claim 1, wherein the fixed profile of power and the fixed profile of delay are substantially parabolic in shape.

3. The apparatus of claim 1, wherein the output controller is operable to apply a greater attenuation to the power of signals in respect of antenna elements towards edges of the array in comparison with the attenuation applied to signals in respect of elements towards a center of the array.

4. The apparatus of claim 1, wherein the time delay unit is operable to apply a greater time delay to signals in respect of antenna elements towards edges of the array in comparison with the delay applied to signals in respect of elements towards a center of the array.

5. The apparatus of claim 1, wherein the output controller includes an arrangement for setting the power of laser carrier signals in respect of each of the antenna elements according to the fixed profile of power.

6. The apparatus of claim 1, wherein the time delay unit includes an arrangement for routing modulated optical carrier signals in respect of each of the plurality of antenna elements over respective fixed optical pathways of different lengths defined according to the fixed profile of time delay.

7. The apparatus of claim 6, further comprising:

an optical beam forming network operable, in addition to applying delays to signals to form each of the multiple beams, to apply the profile of time delay to optical signals passing through the network.

8. The apparatus of claim 1, wherein the wherein the wideband operational frequency range of the wideband antenna extends from 6 to 18 GHz.

9. A method for controlling the shape of beams in a far-field radiation pattern, the method comprising:

generating the far-field radiation pattern from a wideband multiple beam array antenna having a plurality of antenna elements and a wideband operational frequency range;

providing a substantially constant shape of radiation pattern for each of the multiple beams, at any frequency within the wideband operational frequency range of the over antenna, by applying a fixed, non-linear, substantially frequency-independent profile of power and of a time delay to signals in respect of elements of the antenna across the wideband operational frequency range.

10. The method of claim 9, wherein the fixed profile of power and the fixed profile of delay are substantially parabolic in shape.

11. The method of claim 9, further comprising: applying a greater attenuation to the power of signals in respect of antenna elements towards edges of the array in comparison with the attenuation applied to signals in respect of elements towards a center of the array.

12. The method of claim 9, further comprising: applying a greater time delay to signals in respect of antenna elements towards edges of the array in comparison with the time delay applied to signals in respect of elements towards a center of the array.

13. The method of claim 9, wherein the fixed profile of power is applied by setting the power of laser carrier signals in respect of each element of the antenna according to the fixed profile of power.

14. The method of claim 9, wherein the fixed profile of time delay is applied in the optical domain using different lengths of optical fiber.

15. The method of claim 9, wherein the wideband operational frequency range of the wideband antenna extends from 6 to 18 GHz.

* * * * *